US006658773B2

(12) United States Patent
Rohne et al.

(10) Patent No.: US 6,658,773 B2
(45) Date of Patent: Dec. 9, 2003

(54) LABEL WITH LUMINESCENCE INSIDE

(76) Inventors: Dennis Rohne, 10203 Winding Trail Rd., La Porte, TX (US) 77571; Scott Beatty, 8200 Valley Forge Rd., Fort Smith, AR (US) 72903

( * ) Notice: Subject to any disclaimer, the term of this patent is extended or adjusted under 35 U.S.C. 154(b) by 0 days.

(21) Appl. No.: 10/094,303

(22) Filed: Mar. 11, 2002

(65) Prior Publication Data

US 2003/0167669 A1 Sep. 11, 2003

(51) Int. Cl.[7] ..... G09F 13/20

(52) U.S. Cl. ..... 40/542; 40/638; 40/675; 40/595; 400/493

(58) Field of Search ..... 40/594, 595, 337, 40/638, 675; 362/24, 34; 400/493, 490; 283/81

(56) References Cited

U.S. PATENT DOCUMENTS 4,060,703 A 11/1977 Everett, Jr.
5,073,843 A * 12/1991 Magee ..... 362/84
5,290,115 A * 3/1994 Little ..... 400/490
5,477,430 A 12/1995 LaRose
5,698,301 A * 12/1997 Yonetani ..... 40/542
5,793,358 A * 8/1998 Petkovic et al. ..... 345/168
6,036,326 A 3/2000 Yoshikawa et al.
6,048,595 A * 4/2000 Nakajima et al. ..... 40/542
6,129,963 A * 10/2000 Lesko et al. ..... 428/40.1
6,322,229 B1 * 11/2001 Chan et al. ..... 362/23
6,331,083 B1 * 12/2001 Harris ..... 400/493

* cited by examiner

*Primary Examiner*—Gary Hoge
(74) *Attorney, Agent, or Firm*—Richard C. Litman

(57) ABSTRACT

A fluorescent label for a computer keyboard key. The label is adhesive backed, having two layers of plastic vinyl such as Mylar and is rectangular and corresponds with the size of the key face and the character or message on the key. A kit is a sheet, having a set of labels for the various sizes of keys of a computer keyboard and the character or message thereon removable from the. The first layer of plastic vinyl has adhesive for attachment to a key face having a peel off paper backing and having a printed luminescent paint or ink on its upper side. An indicia is printed on the background corresponding to the key. A second layer of transparent plastic vinyl covers the luminescent layer.

15 Claims, 4 Drawing Sheets

28

LABEL WITH LUMINESCENCE INSIDE

BACKGROUND OF THE INVENTION

1. Field of the Invention

The present invention relates to labels. More particularly, the present invention relates to luminescent labels for use on keys of a keyboard.

2. Description of the Related Art

Many consumers (especially game players) prefer to use their personal computer with the monitor on but with the room lights off. This method of viewing (especially when playing games) makes the graphics on the computer monitor easier to see. The problem lies in the fact that the keys on the keyboard are very difficult to see with the lights in the room off. It would be desirable to provide a set of labels with corresponding key indicia which can be attached to normal keyboard keys which may be read in darkness, i.e., which luminesce or "glow in the dark" for a substantial period of time, e.g., up to 20 hours.

U.S. Pat. No. 5,073,843, issued Dec. 17, 1991, to Magee describes a phosphorescent key pad and, alternatively, phosphorescent informational indicia may be so provided in kit form to be selectively applied via an adhesive to a conventional key pad. The adhesive applied key pad '843 patent is intended for use on a remote controller for a television or the like and employs a single sheet of plastic material having the phosphorescent material incorporated within the plastic material. In the time frame of the invention embodied in the '843 patent, phosphorescent material commonly available was zinc sulfide with copper which exhibits phosphorescence which converts absorbed light into visible light, but low photoluminescence (the longer afterglow) . This resulted in a relatively low luminosity which was quick to fade. Compositions of this time period required the addition of radioactive promethium to increase luminosity time; however, the use of promethium was limited due to the dangers of radiation.

The present invention employs recently developed compounds which have enhanced photoluminescence properties without the use of radioactive compounds. They have high luminosity and will glow for 20 hours after only 10 minutes of exposure to light, high endurance which makes them useful for 10 years, and are available in fine particles, allowing for mixing with as carrier and running on a printing press as a luminescent ink. The present invention is easily produced using a printing press and the use of a transparent plastic cover layer bonded to the printed plastic layer assures long life of the product under relatively constant use such as on a keyboard key.

U.S. Pat. No. 4,060,703, issued Nov. 29, 1977, to Everett, Jr., describes a sandwich type computer keyboard with keys and having an electroluminescent panel for illuminating the keyboard panel. The luminescent panel of the '703 patent is continuously driven by an electrical power source.

U.S. Pat. No. 5,477,430, issued Dec. 19, 1995, to LaRose describes a fluorescing display group keypad for use on an automobile control panel which includes a backlit component formed as a molded plastic button. The luminescent button of the '430 patent is continually illuminated by a light source when in use.

U.S. Pat. No. 6,036,326, issued Mar. 14, 2000, to Yoshikawa et al. describes an illuminated keyboard key having flourescent character or indicia thereon. The flourescent key of the '326 button is continuously provided with activation light during use from a light source. Also, there is no protection for the fluorescent material and so is subject to wear during use.

None of the above inventions and patents, taken either singularly or in combination, is seen to describe the instant invention as claimed. Thus, a label with luminescence inside solving the aforementioned problems is desired.

SUMMARY OF THE INVENTION

The present invention is a fluorescent label for placing on a standard key of a computer keyboard which has the same character as the key and is readable in a dark room. The label is adhesive backed, having two layers of plastic vinyl such as Mylar. The label is rectangular and corresponds with the size of the upper surface of the key with which the character on the label corresponds. A kit is provided having a complete set of labels for the various sizes of keys of a desk-top computer keyboard with the character corresponding to the particular size of any keyboard key. The first layer of plastic vinyl has an adhesive for attachment to the key working surface with a peel off paper backing on the underside and a printed colored luminescent paint or ink on its upper side. A character is printed on the background corresponding to the character on the key. A second layer of transparent plastic vinyl is applied as a protective cover to the first layer by heat sealing or adhesive bonding so as to protect the luminescent printing from wearing away during use.

The kit is a sheet of printed label material which is die cut to form the rectangular labels so as to allow the labels to be removed by the user for application to his computer keyboard. The user may trim particular labels to fit his particular keyboard as necessary. The resulting keyboard will exhibit photoluminescence for up to 20 hours after exposure to light for as little as 10 minutes, making it practical for use in playing computer games, etc.

Accordingly, it is a principal object of the invention to provide a label for application to the upper surface of a keyboard key which is visible for long periods in a darkened room.

It is another object of the invention to provide a label as above which provides visibility by photoluminescence of the key such as to allow visual identification of the character the key displayed thereon.

It is a further object of the invention to provide a label as above which renders the key useable in a darkened room for up to 20 hours after exposure to ambient light for as little as 10 minutes.

Still another object of the invention is to provide a label as above having a transparent plastic cover layer to protect the luminescent portion from wear during repeated use of the key such as occurs when playing games on a computer using a keyboard.

Yet another object of the invention is to provide a label as above which has a useful life of up to 10 years.

Still another object of the invention is to provide a kit having a set of labels as above corresponding to the characters or indicia and the shape of all the keys of a standard computer keyboard.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a fluorescent label for placing on a standard key of a computer keyboard which has the same character as the key and is readable in a dark room. The label is adhesive backed, having two sheets or layers of plastic vinyl such as Mylar. The label is rectangular and corresponds with the size of the upper surface of the key with which the character on the label corresponds. A kit is provided having a complete set of labels for the various sizes of keys of a desk-top computer keyboard with the character corresponding to the particular size of any keyboard key. The first layer of plastic vinyl has an adhesive for attachment to the key working surface with a peel off paper backing on the underside and a printed colored luminescent paint or ink on its upper side. A character is printed on the background corresponding to the character on the key.

A second layer of transparent plastic vinyl is applied as a protective cover to the first sheet or layer by heat sealing or adhesive bonding so as to protect the luminescent printing from wearing away during use. The kit is a sheet of printed label material which is die cut to form the rectangular labels so as to allow the labels to be removed by the user for application to his computer keyboard. The user may trim particular labels to fit his particular keyboard as necessary. The resulting keyboard will exhibit photoluminescence for up to 20 hours after exposure to light for as little as 10 minutes, making it practical for use in playing computer games, etc.

Figure 1:
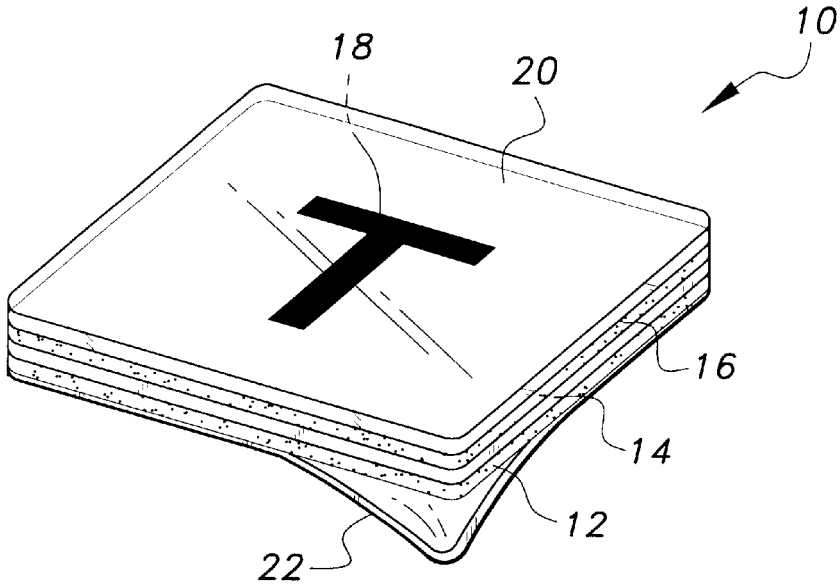
FIG. 1 is a perspective view of a keyboard key label having luminescence according to the present invention.

Referring to FIG. 1, there is shown a perspective view of a keyboard luminescent label 10. Label 10 includes a lower plastic sheet adhesive layer 12 applied to the underside of lower plastic sheet 14. A layer of luminescent paint or ink 16 is applied to the upper side of plastic sheet or layer 14. A character or message 18 is printed on the luminescent paint or ink layer 16 with opaque ink. An upper transparent plastic sheet cover 20 is applied over the luminescent ink layer 16 by thermal induced adhesion or by a transparent adhesive such that luminescent ink layer 16 and opaque character 18 may be observed through the cover 20. Paper cover 22 protects the adhesive layer 12 until the label is prepared for attachment to a keyboard key at which time paper cover 22 is peeled away and discarded.

Figure 2:
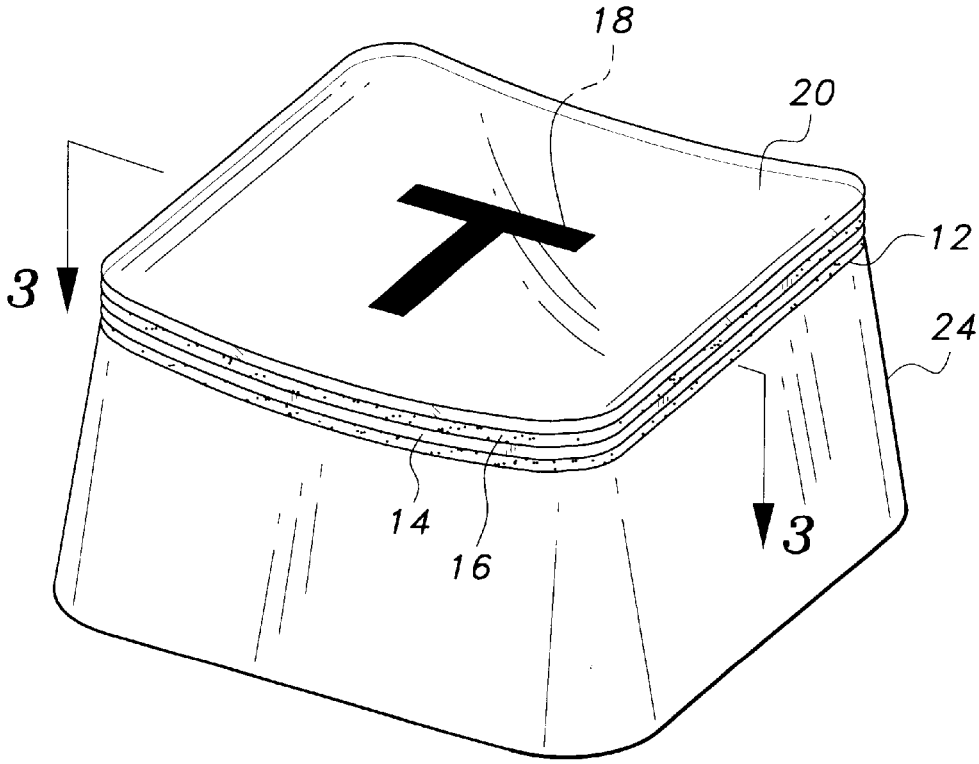
FIG. 2 is a perspective view of a keyboard key with the label of FIG. applied on the working surface.
Figure 3:
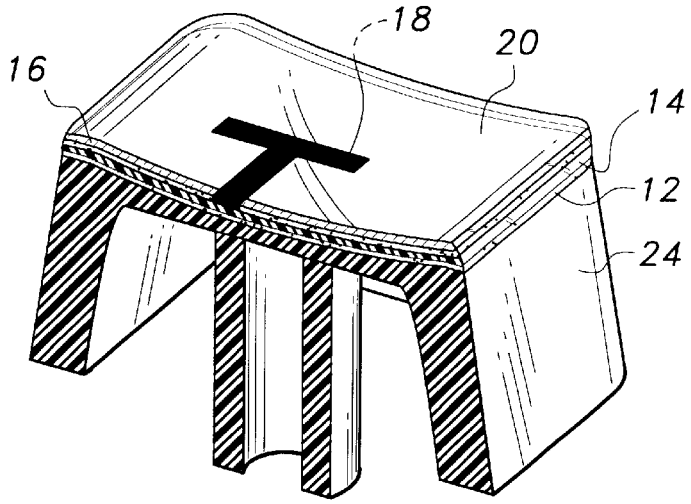
FIG. 3 is a sectional view of a keyboard key of FIG. 2 taken along the line 3—3.

Referring to FIGS. 2 and 3, there are shown a perspective view and a sectional view of the label of FIG. 1 as applied to the face of a computer keyboard key 24. As is shown, lower plastic sheet or layer 14 adheres to the face of key 24 by means of adhesive layer 12. Luminescent ink layer 16 is printed or otherwise applied to the upper side of lower plastic sheet or layer 14 upon which character or message 18 is printed or otherwise applied. Upper plastic sheet cover 20 adheres to the luminescent ink layer 16 and protects the label from wear. The character or message 18 blocks the luminescent light from the ink layer 16 allowing the character to be read against the luminescent light background.

Figure 4:
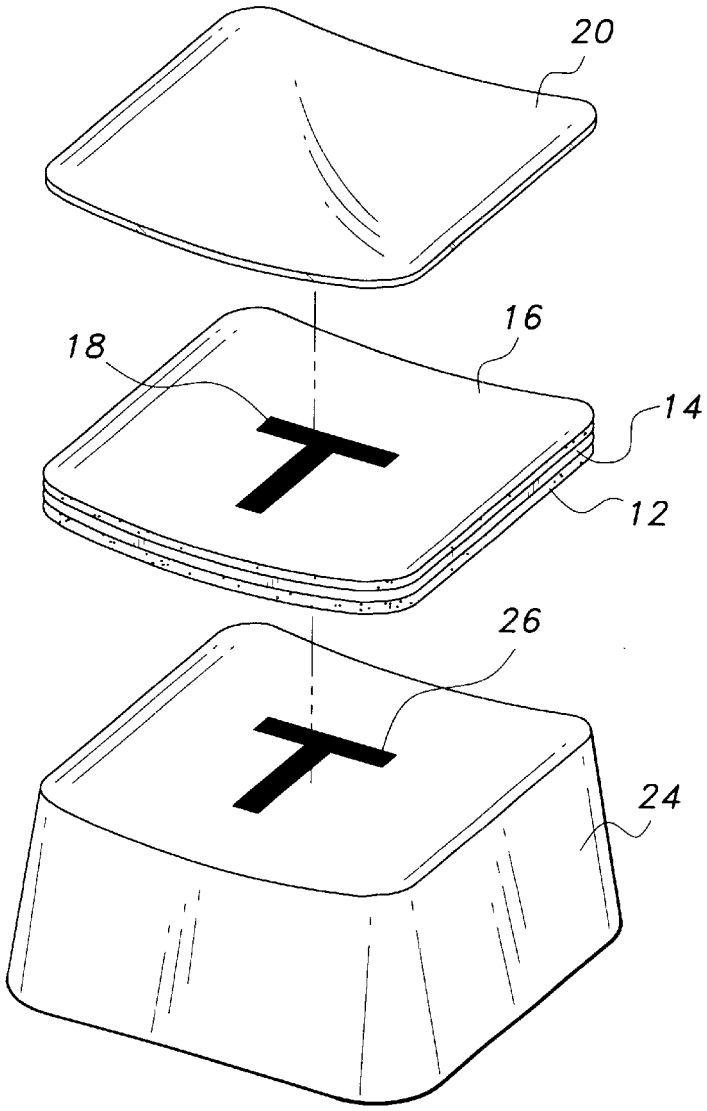
FIG. 4 is an exploded view of the luminescent keyboard label and key of FIG. 2.
Figure 5:
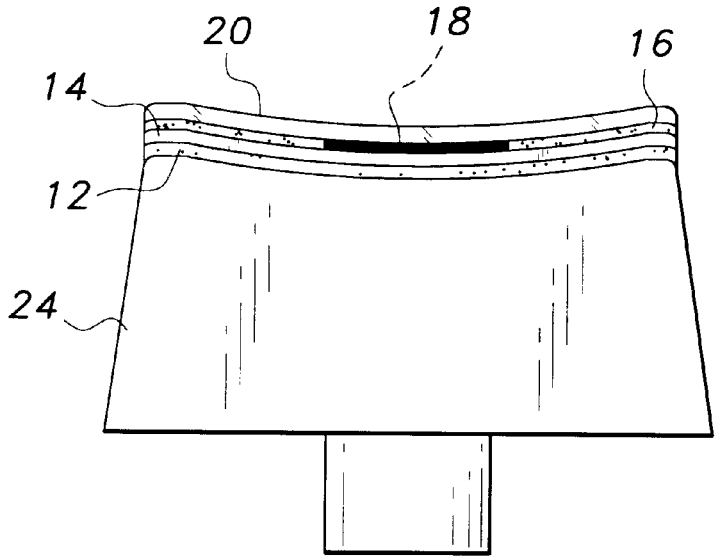
FIG. 5 is a front elevation view of the luminescent keyboard label as applied to a keyboard key as in FIG. 2.
Figure 6:
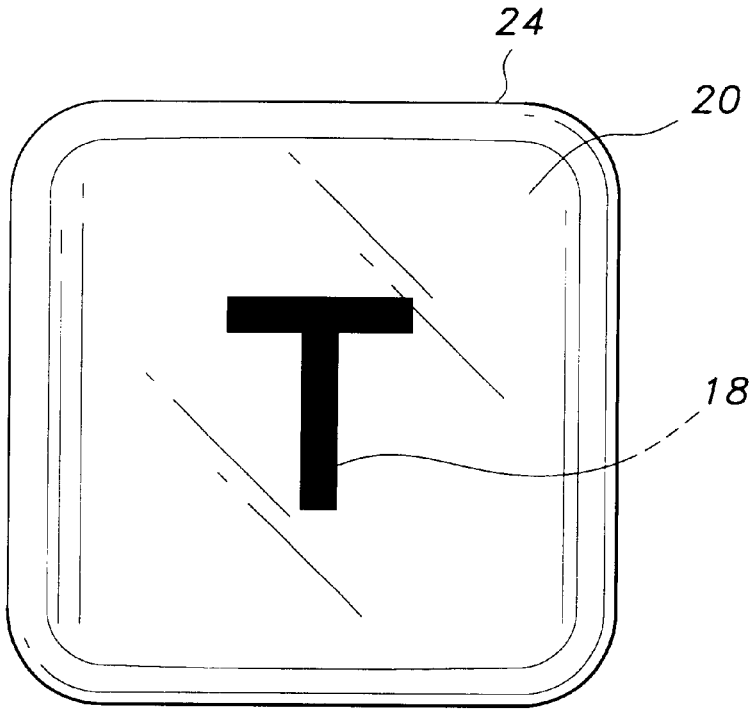
FIG. 6 is a top view of the luminescent keyboard label as applied to a keyboard key as in FIG. 1.

Referring to FIGS. 4, 5, and 6 there are shown an exploded view, a front elevation view, and a top view of the computer keyboard key 24 having the inventive luminescent keyboard label mounted to its face. As seen in FIG. 4, the face of key 24 has a character 26, and the character 18 printed on luminescent ink layer is identical to character 26.

Figure 7:
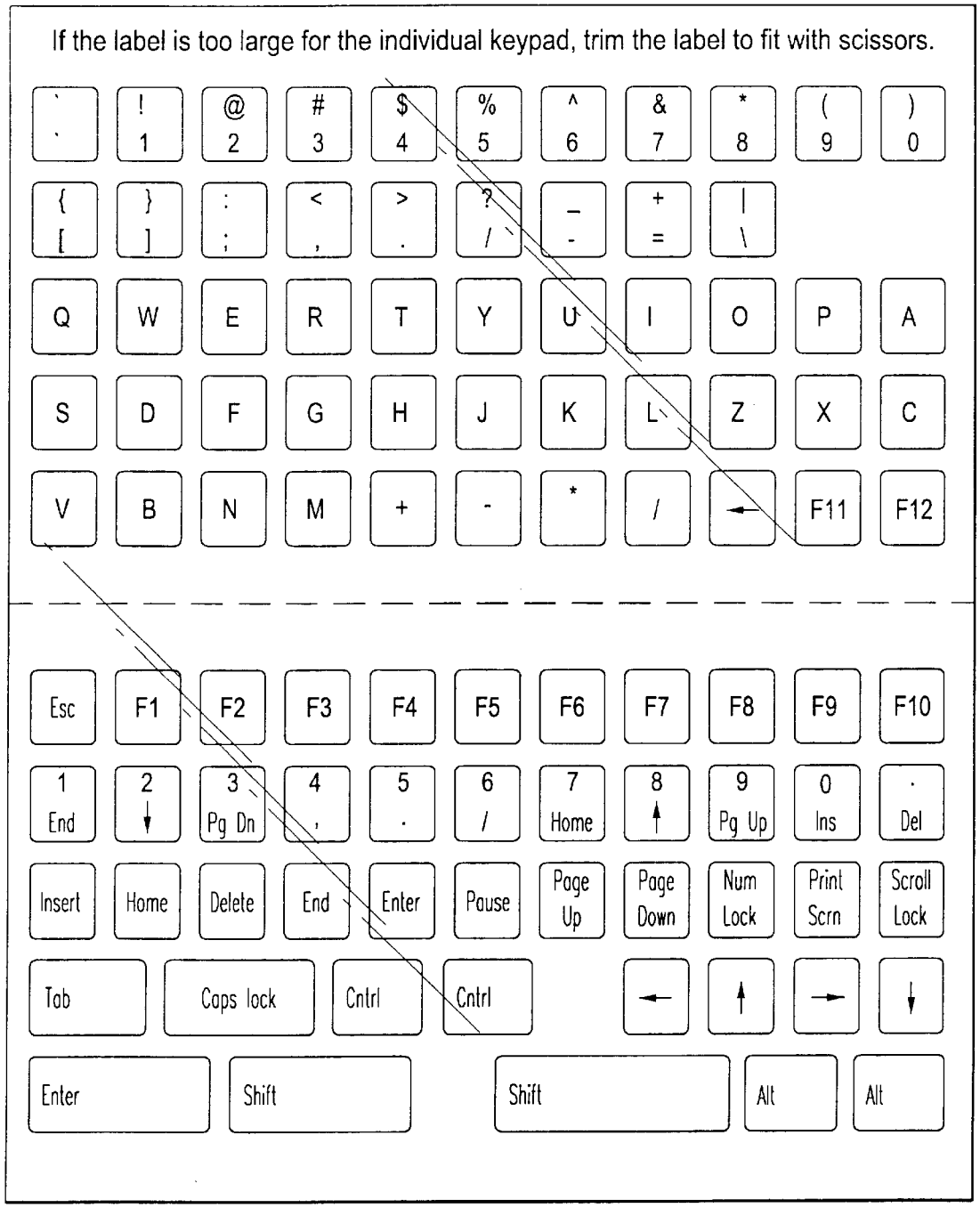
FIG. 7 is a plan view of a kit providing a set of luminescent keyboard labels in FIG. 1 for a computer keyboard.

Referring to FIG. 7, there is shown a top view of a kit 28 having labels 10 (see FIG. 1) for all the commonly used computer keyboard keys. The labels are die cut from the kit sheet to a point that they may be easily snapped out by the user for application to his computer keyboard.

The phosphorescent material of the present invention is in a powder form of 400 mesh size. Because of the fine particle size, the phosphorescent powder can be mixed with white ink in a preferred ratio of 2 parts powder to 3 parts ink. The phosphorescent ink can be run through a printing press to create the phosphorescent background on the label and standard black ink applied to form the characters of the computer keyboard. Alternatively, the ink may be painted on by any means desired.

When the label background is printed with phosphorescent/white ink mixture, it will appear to be an off-white, cream color under natural light. This cream colored background with flat black letters appears similar to the standard computer keyboard color during the day. In the dark, the cream color turns to a light-green glow that will continue for 20 hours after as little as 10 minutes of exposure to light. The long glow period is due to photoluminescence, the long afterglow of phosphorescence. Prior luminescent key designs depend on phosphorescence and generally require the presence of light to maintain its glow character. The luminescent material employed in compounding the ink useful in the present invention is proprietary to Korak International Corporation, El Monte, California and is designated "Nightlight 20." The material contains rare earth materials and is generally described on their website: www.nightlight20.com.

In operation, the user breaks away a desired label 10 from the kit sheet 28. He then checks the size relative to his keyboard key and, if necessary, trims the label 10 to fit. He then peels the paper backing and applies the label 10 to the face of the corresponding key. The labeled key must be exposed to light for at least 10 minutes before being readable in the dark.

It is to be understood that the present invention is not limited to the embodiment described above, but encompasses any and all embodiments within the scope of the following claims.

We claim:

1. A luminescent label as applied, covering a keyboard key comprising:

a lower sheet having an underside and an upper side;

a layer of adhesive on said underside for adhering said lower sheet to the face of a keyboard key;

a layer of luminescent material on said upper side, said layer of luminescent material printed with two parts luminescent powder to 3 parts white ink; and an opaque character or message located on said luminescent material layer;

whereby said luminescent material allows the user the ability to see said label as applied to a keyboard key in dark conditions for up to 20 hours after said luminescent material is exposed to light for at least 10 minutes.

2. The luminescent label of claim 1, further comprising an upper transparent layer applied to said layer of luminescent material and covering said opaque character or message for protection of said layer of luminescent material from wear during use of said keyboard key.

3. The luminescent label of claim 2, wherein said lower sheet and said upper layer are coextensive sheets of vinyl plastic.

4. The luminescent label of claim 1, wherein said luminescent layer is printed on said lower sheet.

5. The luminescent label of claim 4, wherein said character or message is printed on said luminescent layer.

6. The luminescent label of claim 5, wherein said luminescent layer exhibits substantial properties of photophosphorescence.

7. The luminescent label of claim 6, wherein said luminescent layer comprises a powdered luminescent material known as Nightlight 20.

8. The luminescent label of claim 6, wherein said luminescent layer is cream colored in ambient light and green colored in the dark.

9. The luminescent label of claim 2, wherein said upper transparent layer is applied by heat and pressure.

10. The luminescent label of claim 1, wherein said adhesive layer has a peel-off backing which is removed before application of said label to said keyboard key.

11. An article of manufacture comprising:

a lower sheet of vinyl plastic having an underside and a upper side and so sized as to cover the face of a computer keyboard key;

a layer of adhesive located on said lower side;

a peel-off paper backing located underneath said layer of adhesive for removal before application of said label;

a luminescent layer printed on said upper side of said lower sheet with a layer of luminescent ink, said luminescent ink comprises 2 parts Nightlight 20 powder and 3 parts white ink;

a character or message printed upon said layer of luminescent ink; and an upper cover sheet of transparent vinyl plastic located upon said luminescent layer.

12. The article of manufacture of claim 11, wherein said label appears cream color under ambient light and appears green in the dark.

13. A kit providing a set of luminescent labels according to claim 10 for covering corresponding keys on a computer keyboard comprising a sheet of label material, said sheet of label material displaying a plurality of discreet characters and messages corresponding to those of a computer keyboard, said sheet of label material being die cut around each of said discreet character and messages to form a label having dimensions corresponding to the face of the computer keyboard key corresponding to the character or message displayed on said sheet of label material, said die cut being such that said labels are retained in said sheet form, but are easily removed from said sheet for use.

14. A luminescent label as applied, covering a keyboard key comprising:

a lower sheet having an underside and an upper side;

a layer of adhesive on said underside for adhering said lower sheet to the face of a keyboard key;

a layer of luminescent material on said upper side, said layer of luminescent material printed with luminescent ink comprising 2 parts Nightlight 20 powder and 3 parts white ink and an opaque character or message located on said luminescent material layer;

whereby said luminescent material allows the user the ability to see said label as applied to a keyboard key in dark conditions for up to 20 hours after said luminescent material is exposed to light for at least 10 minutes.

15. The luminescent label of claim 14, wherein said label appears cream color under ambient light and appears green in the dark.

* * * * *